US005353508A

United States Patent [19]

Baker

[11] Patent Number: 5,353,508

[45] Date of Patent: Oct. 11, 1994

[54] BORDER CUTTER

[75] Inventor: David H. Baker, Garden Grove, Calif.

[73] Assignee: Roberts Consolidated Industries, Inc., City of Industry, Calif.

[21] Appl. No.: 53,472

[22] Filed: Apr. 29, 1993

[51] Int. Cl.[5] ..... B26B 29/06

[52] U.S. Cl. ..... 33/42; 33/527; 30/294; 30/293

[58] Field of Search ..... 30/294, 280, 286, 293, 30/314, 374, 375, 376; 33/32.1, 32.3, 32.7, 41.6, 481, 42, 527

[56] References Cited

U.S. PATENT DOCUMENTS

| | | | |
|---|---|---|---|
| 1,589,910 | 6/1926 | Waterloo | 33/32.1 |
| 2,019,175 | 10/1935 | Crowley et al. | 33/32.1 |
| 2,845,713 | 8/1958 | Macaulay | 33/32.1 |
| 3,394,457 | 7/1968 | Holder | 33/32.1 |
| 3,827,468 | 8/1974 | Markham | 33/32.3 |
| 3,905,100 | 9/1975 | Kleine et al. . | |
| 4,148,142 | 4/1979 | Sullivan et al. . | |
| 4,646,439 | 3/1987 | Squires . | |
| 4,813,141 | 3/1989 | Funger . | |
| 4,868,989 | 9/1989 | Renaud . | |
| 5,050,306 | 9/1991 | Renaud . | |
| 5,083,375 | 1/1992 | Helm, Sr. . | |
| 5,103,570 | 4/1992 | Nichols | 33/481 |
| 5,159,758 | 11/1992 | MacDonald . | |
| 5,203,086 | 4/1993 | Dann | 30/293 |

OTHER PUBLICATIONS

"Trimmers and Cutters", p., 25, (pub. date & publication unknown).

"Laying of floor coverings", p. 10, (publication & pub. date unknown).

"Cutting, Upright Cutter", p. 5, (publication & pub. date unknown).

"Carpetcrafter (6" Cutting Tool)", 3 pages of brochure, (pub. date unknown).

"Carpetcrafter (With 18" Carpet Guide Base)", 2 pages of brochure, (pub. date unknown).

*Primary Examiner*—Richard K. Seidel

*Attorney, Agent, or Firm*—Harris, Wallen, MacDermott & Tinsley

[57] ABSTRACT

A border cutter for use with a cutter blade carrier for cutting a strip of carpet, the carrier having a blade plate for a cutting blade, the border cutter including a surface plate for movement along a piece of carpet, and having a guide edge and a cutting blade opening normal to the guide edge, and having spaced guides with aligned slots for receiving the carrier plate for positioning a blade at the blade opening. The spaced guides extend parallel to the blade opening, with each guide having a plurality of slots extending therealong in alignment with the slots of the other guide, providing a plurality of locations on the surface plate for the blade carrier. One of the spaced guides includes a channel for receiving a guide toe plate of a blade carrier support of the blade carrier.

4 Claims, 2 Drawing Sheets

BORDER CUTTER

BACKGROUND OF THE INVENTION

This invention relates to laying carpet and in particular, to a tool for trimming a carpet to fit into a particular space.

When laying carpet, sometimes it is desirable to remove a strip of uniform width from an edge of the carpet. This is usually accomplished with a tool known as a border cutter or strip cutter. The coventional border cutter includes a carrier for a cutting blade and an arrangement for positioning the blade carrier with respect to the edge of the carpet to be cut or trimmed. Usually, some form of adjustment is provided for determining the width of the strip to be cut. In the prior art devices, the cutter blade carrier is moved relative to a guide edge along a rod or strip and is held in place by thumb screws or the like which clamp the blade carrier to the guide rod or strip. Examples of this construction are shown in U.S. Pat. Nos. 4,148,142; 4,646,439; 4,868,9894; and 5,050,306.

One disadvantage of such construction is that the operator must measure the position of the blade carrier relative to the guide edge and then tighten the thumb screws. Another disadvantage is that, unless the screws are continuously tightened, there is the likelihood that they will loosen and the width of the cut will vary during the cutting operation.

Earlier border cutters cut the carpet from the face or top portion of the carpet. One problem with this arrangement is that during the cutting process, the nap or face yarns can be cut, shaved, pulled-out or disfigured, allowing the completed seam to be visible. Some border cutters are inserted below the carpet surface and require the combination of pushing the tool by one installer and pulling by another. This operation requires two people, is difficult and slow, and allows for mistakes such as aforementioned nap loss or disfigurement, and/or edges cut on a bevel.

Many current border cutters use specialty blades that are generally limited in the amount of available cutting surface and are not always available at all distributor locations. Also the cost of such blades is generally higher than the standard blade.

SUMMARY OF THE INVENTION

Accordingly, it is an object of the present invention to provide a new and improved border cutter which incorporates specific positions for setting the width of the strip to be cut, and also which provides for positive positioning of the blade carrier with respect to the guide edge so that a constant strip width is maintained throughout the cutting operation.

In the presently preferred embodiment of a border cutter for use with a cutter blade carrier for cutting a strip of carpet, the border cutter includes a surface plate for movement along a piece of carpet and having a guide edge and a cutting blade opening spaced from the guide edge, and spaced guides with aligned slots for receiving the carrier plate for positioning a blade at the blade opening. The spaced guides extend parallel to the blade opening, with each guide having a plurality of slots extending therealong in alignment with the slots of the other guide, providing a plurality of locations on the surface plate for the blade carrier. One of the spaced guides includes a channel between the surface plate and guide. The border cutter further includes a blade carrier support thereon with a guide toe plate for sliding engagement in the channel.

These and other objects, advantages, features and results will more fully appear in the course of the following description.

DESCRIPTION OF THE PREFERRED EMBODIMENT

Figure 1:
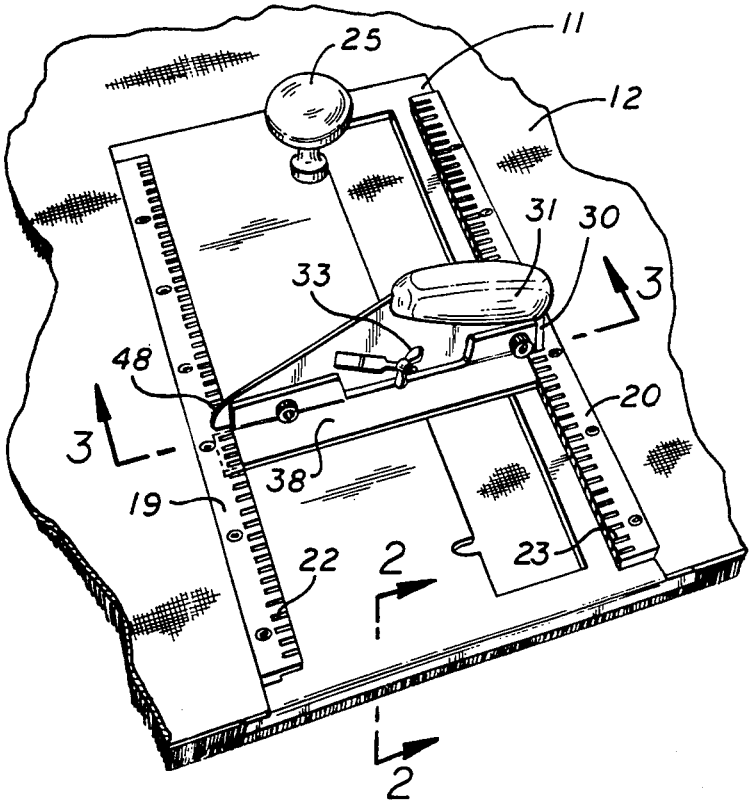
FIG. 1 is a perspective view illustrating a border cutter in position on a carpet, and incorporating the presently preferred embodiment of the invention.
Figure 2:
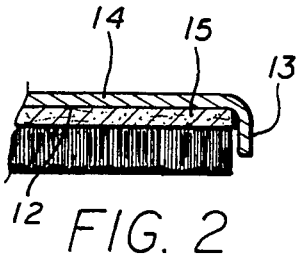
FIG. 2 is an enlarged partial sectional view taken along the line 2—2 of FIG. 1.
Figure 3:
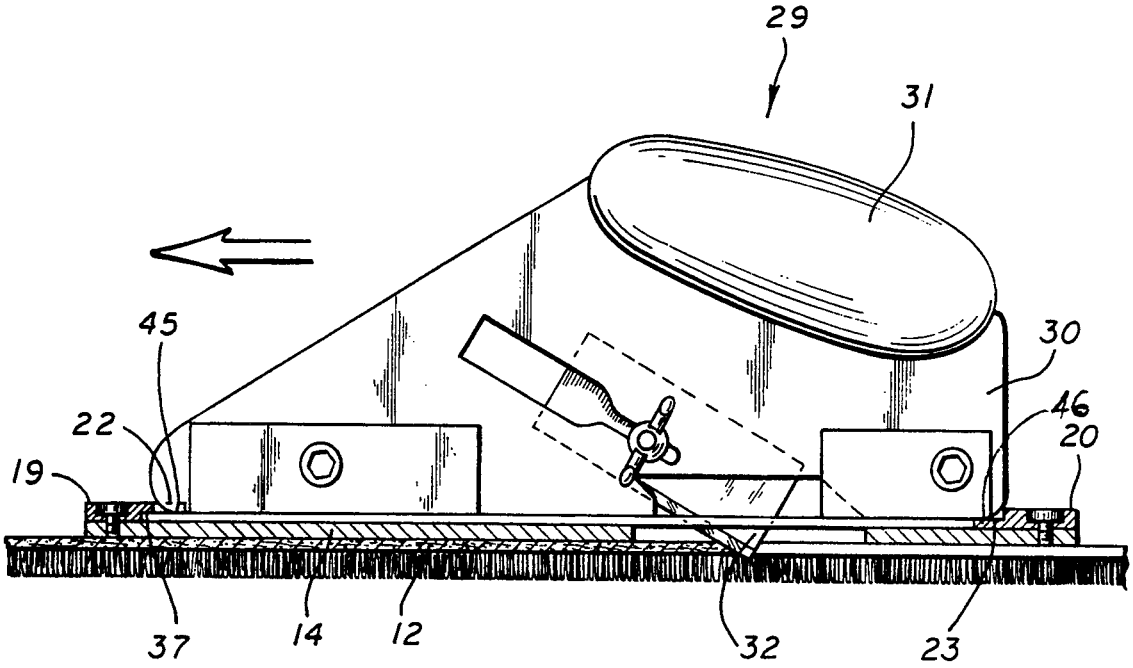
FIG. 3 is an enlarged partial sectional view taken along the line 3—3 of FIG. 1.
Figure 4:
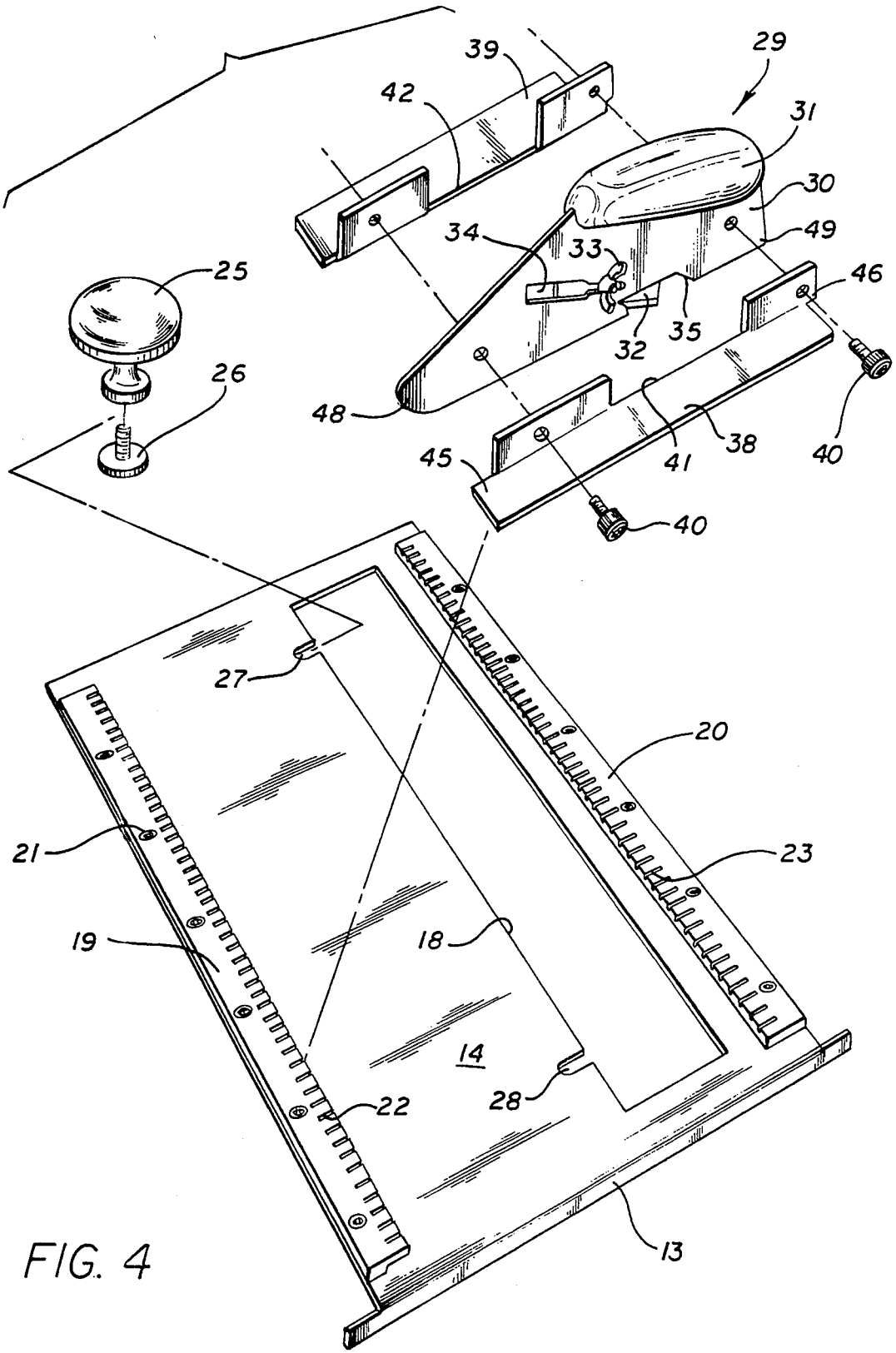
FIG. 4 is an exploded view of the border cutter of FIG. 1.

FIG. 1 illustrates the border cutter 11 resting on a carpet 12 with a guide edge 13 of a surface plate 14 of the border cutter overhanging an edge 15 of the carpet 12.

The surface plate 14 has a cutting blade opening 18 therethrough, with the opening spaced from and extending normal to the guide edge 13. Spaced guides 19, 20 are attached to the surface plate 14, typically by screws 21.

A plurality of slots 22 is provided in the guide 19, and a corresponding plurality of slots 23 is provided in the guide 20, with corresponding slots of the two guides aligned with each other. The guides are spaced from each other and extend parallel with the cutting blade opening 18, normal to the guide edge 13, and typically the slots are spaced at $\frac{1}{4}''$ intervals preferably with dimensions marked on the guides. While it is preferred to have a set of slots in each of the guides 19, 20, it should be recognized that the border cutter could be constructed and operated with only one set of slots if desired.

A hand grip 25 may be removably attached to the surface plate 14, as by a screw 26 and grip slots 27, 28. With this arrangement, the operator can chose the location of the hand grip for ease of operation.

A cutter blade carrier 29 has a blade plate 30 and a handle 31, and may be conventional in design. A cutting blade 32 is adjustably mounted on the cutter blade carrier with a screw and wing nut 33 in a slot 34 for selectively positioning the cutting blade at a notch 35.

In the preferred embodiment illustrated, the guide 19 has a relieved section forming a channel 37 between the guide and the surface plate 14. A blade carrier support 38 and another blade carrier support 39 are attached to the blade plate 30 by screws 40. Preferably the blade carrier supports are angle members, with vertical portions for positioning on each side of the blade and horizontal portions for resting on the surface plate 14. A notch 41 is provided in the support 38 and a notch 42 in the support 39 to provide access to the screw and wing nut 33 for adjusting the position of the cutting blade 32.

A guide toe plate 45 is provided on the forward end of the blade carrier support 38 for fitting into the channel 37 formed by the guide 19 and surface plate 14. The rear end 46 of the blade carrier support 38 is cut square for sliding along the guide 20. If desired, the blade carrier support 38 may have a similar construction.

The guides 19, 20 are positioned on the surface plate 14 so that the forward edge 48 of the blade plate 30 engages a slot in the guide 19, and the rear edge 49 of the blade plate engages an aligned slot in the guide 20.

In use, the width of the strip to be removed from the carpet is determined. Then the cutter blade carrier is positioned on the surface plate with the guide toe plate 45 in the channel 37 and with the forward and rear edges 48, 49 of the blade plate in the slots which will provide the desired width of strip. The operator may then put the hand grip 25 in one of the grip slots 27, 28 and using hand grip 25 and the handle 31 to place the border cutter at one side of the carpet and move the border cutter along the carpet to make the desired cut.

Advantages of the present invention include the ability to use a standard double-edge slotted blade, with a multitude of cutting surfaces. Slotted blades are available at most distributor locations at competitive prices. Another advantage is the ability to perform all cutting from the back side of the carpet. The carpet is rolled out face down, the border cutter is laid on top of the carpet backing, and is pushed along, using the carpet edge as the starting point. Because the cutter is lying flat on the carpet backing, the cut is always at a perfect 90° angle with no beveling at the edges.

Cutting from on top the carpet backing has other advantages: 1. the slotted blade can be adjusted for the thickness of only the carpet backing so the blade never encounters any of the face yarns, and thus nap loss or any disfigurations are eliminated; 2. because the weight of the carpet is supported, the speed of use of the border cutter is only limited to the speed of the individual who is pushing the tool; 3. cutting is done faster and more precise than any other available tool on the market, including a straight-edge and razor blade knife; and 4. the carpet can be flat and remain stationary with the cutter doing all the work. These advantages are achieved because: a. the cutter is pushed, not pulled; b. the operator cannot vary the angle of cut, which is always at a 90° angle; c. if adjusted correctly, the blade will not cut so deep as to cause damage to the face yarns; and d. because the cutter is pushed away from the operator and the blade is well protected below the plate and carpet surface, there is minimal chance of the operator being seriously cut or injured, unlike a straight-edge and knife.

I claim:

1. A border cutter for cutting a strip of carpet, said border cutter including a single surface plate for resting on and moving along a piece of carpet, said surface plate having a guide edge for engaging and moving along an edge of a carpet and a cutting blade opening spaced from said guide edge, said surface plate having spaced guides with a plurality of aligned slots in said guides providing a plurality of locations on said surface plate for receiving a carrier blade plate supporting a cutting blade for positioning and retaining said carrier blade plate on said surface plate parallel to said guide edge with a cutting blade at said blade opening, said border cutter further including blade carrier supports for mounting a cutter blade carrier on said border cutter surface plate in said aligned slots wherein said border cutter is placed on and pushed along the carpet so that said surface plate rests on the carpet with said cutter guide edge engaging the edge of the carpet.

2. A border cutter for cutting a strip of carpet, said border cutter including a single surface plate for resting on and moving along a piece of carpet, said surface plate having a guide edge for engaging and moving along an edge of a carpet and a cutting blade opening spaced from said guide edge, said surface plate having spaced guides with a plurality of aligned slots in said guides providing a plurality of locations on said surface plate for receiving a carrier blade plate supporting a cutting blade for positioning and retaining said carrier blade plate on said surface plate parallel to said guide edge with a cutting blade at said blade opening, said border cutter further including blade carrier supports each having a guide toe plate for sliding engagement in a channel defined by one of said guides for mounting a cutter blade carrier on said border cutter surface plate in said aligned slots wherein said border cutter is placed on and pushed along the carpet so that said surface plate rests on the carpet with said cutter guide edge engaging the edge of the carpet.

3. The combination as defined in claim 2 wherein said blade carrier supports have a flat bottom surface with said guide toe plate at one end.

4. The combination as defined in claim 3 wherein said blade carrier supports comprise ninety degree angle members with said angle members joined together providing a flat surface resting on said surface plate.

* * * * *